US009506206B2

(12) United States Patent
Pucciarelli

(10) Patent No.: US 9,506,206 B2
(45) Date of Patent: Nov. 29, 2016

(54) EXPANSION JOINT STRAIGHTENER CONTROL JOINT TOOL AND RELATED METHODS

(71) Applicant: Joseph A. Pucciarelli, Pittsburgh, PA (US)

(72) Inventor: Joseph A. Pucciarelli, Pittsburgh, PA (US)

( * ) Notice: Subject to any disclaimer, the term of this patent is extended or adjusted under 35 U.S.C. 154(b) by 0 days.

(21) Appl. No.: 14/691,611

(22) Filed: Apr. 21, 2015

(65) Prior Publication Data

US 2016/0312415 A1 Oct. 27, 2016

Related U.S. Application Data

(60) Provisional application No. 61/984,912, filed on Apr. 28, 2014.

(51) Int. Cl.
*E01C 23/02* (2006.01)

(52) U.S. Cl.
CPC ..... *E01C 23/02* (2013.01)

(58) Field of Classification Search
CPC ..... E01C 23/00; E01C 23/02
USPC ..... 404/74, 87
See application file for complete search history.

(56) References Cited

U.S. PATENT DOCUMENTS 1,267,301 A * 5/1918 Wieberg ..... E01C 23/023 404/87
1,273,060 A * 7/1918 Hoff ..... E04F 21/24 15/235.7
1,974,240 A * 9/1934 Heltzel ..... E01C 19/405 404/74
1,997,216 A * 4/1935 Heltzel ..... E01C 23/02 404/74
2,014,894 A * 9/1935 Heltzel ..... E01C 23/02 404/74
2,025,449 A * 12/1935 Heltzel ..... E01C 23/026 404/74
2,617,336 A * 11/1952 Brickler ..... E01C 23/025 15/235.3
3,473,450 A * 10/1969 Koch ..... E01C 23/026 404/87
4,155,141 A * 5/1979 Guerra ..... E01C 19/44 15/235.3
4,299,513 A * 11/1981 Stegmeier ..... E01C 23/025 15/105.5
5,160,748 A * 11/1992 Gauuan ..... E04F 21/24 15/235.4

* cited by examiner

*Primary Examiner* — Abigail A Risic
(74) *Attorney, Agent, or Firm* — Eckert Seamans Cherin & Mellott, LLC; Arnold B. Silverman

(57) ABSTRACT

A tool for concrete construction has a base provided with downwardly open channel for receiving an expansion joint with movement of tool effecting straightening of expansion joint. Generally upwardly directed flanges are structured to be cooperating with a straight edge for facilitating straight movement of tool during straightening of expansion joint. The tool may also be employed to establish control joints. Related methods are provided.

27 Claims, 6 Drawing Sheets

EXPANSION JOINT STRAIGHTENER CONTROL JOINT TOOL AND RELATED METHODS

CROSS REFERENCE TO A RELATED APPLICATION

This application claims the benefit of U.S. Provisional Application Ser. No. 61/984,912, entitled Expansion Joint Straightener/Control Joint Tool, which was filed on Apr. 28, 2014, the disclosure of which is incorporated herein by reference.

BACKGROUND OF THE INVENTION

1. Field of the Invention

The present invention relates to a tool for facilitating the straightening of expansion joints in concrete construction and establishment of control joints therein along with related methods.

2. Description of the Prior Art

When pouring concrete slabs, expansion joints are needed for expansion and contraction that occurs in response to temperature changes in the weather and control joints are needed to help control cracking of the concrete as it cures.

Setting an expansion joint is a difficult aspect of concrete construction. In order to make the finished product look professional and attractive, it is essential that the expansion joint be straight, without any kinks, curves, or slants in it over its entire length. This "straightening" of the expansion joint has traditionally been done visually. This requires the worker to stand to look at the expansion joint, then bend to tap it into place at various locations, standing to look at it again, going back on his or her knees to tap it into place this way or that, standing to look at it again, back down on your knees to make any further adjustments, standing again, until the desired result is achieved. This is an iterative process that could go on for five to ten cycles before the expansion joint is only visually straight, but may not be truly straight, thereby resulting in an aesthetically inferior expansion joint set.

There remains, therefore, a very real and substantial need for an improved means of providing a straight expansion joint in concrete construction and to provide appropriate control joints.

SUMMARY OF THE INVENTION

The tool of the present invention also eliminates the iterative and inefficient process of getting up and down multiple times by providing a perfectly straight expansion joint. With one pass of the tool forward and one pass backward, a straight expansion joint is achieved, giving the concrete work a beautiful, professional appearance. The tool has a manually engageable handle secured to an underlying base. The base has a downwardly open elongated, generally centrally located expansion joint receiving channel and a pair of generally upwardly projecting parallel flanges adjacent to the lateral edges thereof.

The tool and related method of the present invention also provides an efficient means of establishing a control joint by placing an insert piece into the tool and effecting tool movement.

It is an object of the present invention to provide an expansion joint straightener tool and associated method which facilitates providing a straight expansion joint.

It is another object of the present invention to provide such a tool and associated method which facilitates employing a tool insert piece to create straight control joints.

It is yet another object of the present invention to provide such a tool and associated method wherein a downwardly projecting expansion joint guide channel and upwardly projecting straight edge guide flanges contribute to achieving the desired straight expansion joint.

It is a further object of the present invention to provide a uniquely configured control joint insert for use with the tool and associated method of the present invention.

These and other objects of the invention will be more fully understood from the following description of the invention on reference to the illustrations appended hereto.

DESCRIPTION OF THE PREFERRED EMBODIMENTS

Figure 1:
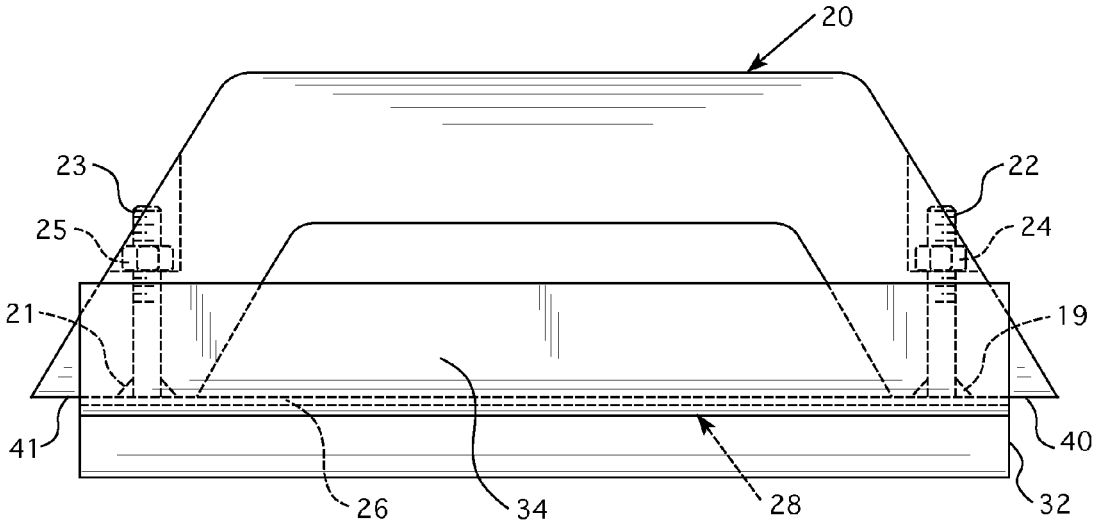
FIG. 1 is a front elevational view of the expansion joint straightener tool of the present invention.
Figure 2:
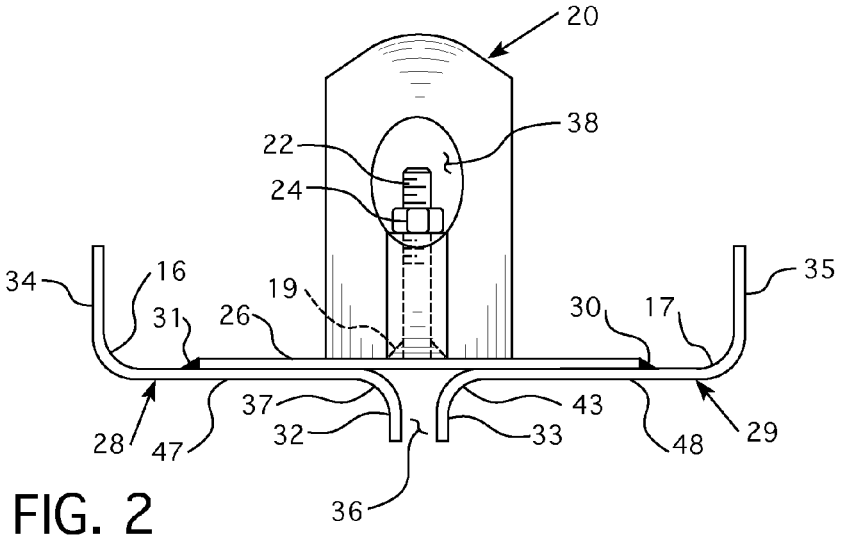
FIG. 2 is right side elevational view of the tool of FIG. 1.
Figure 3:
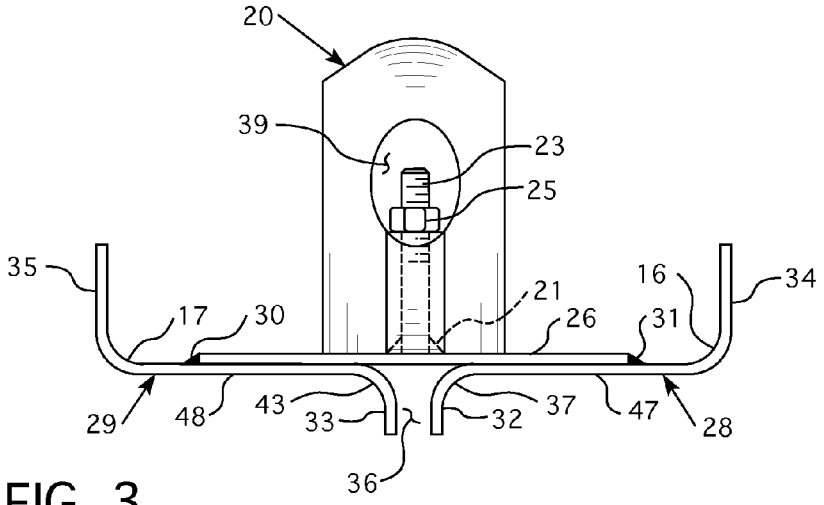
FIG. 3 is a left side elevational view of the tool of FIG. 1.
Figure 4:
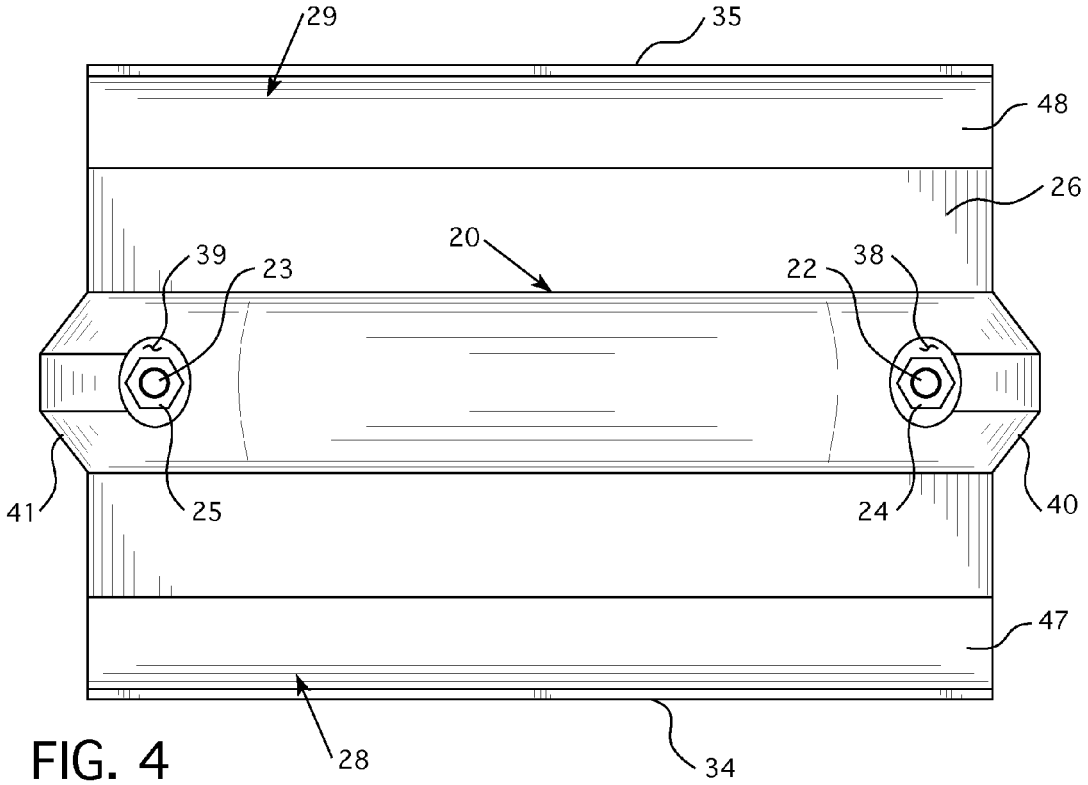
FIG. 4 is a top plan view of the tool of FIG. 1.
Figure 5:
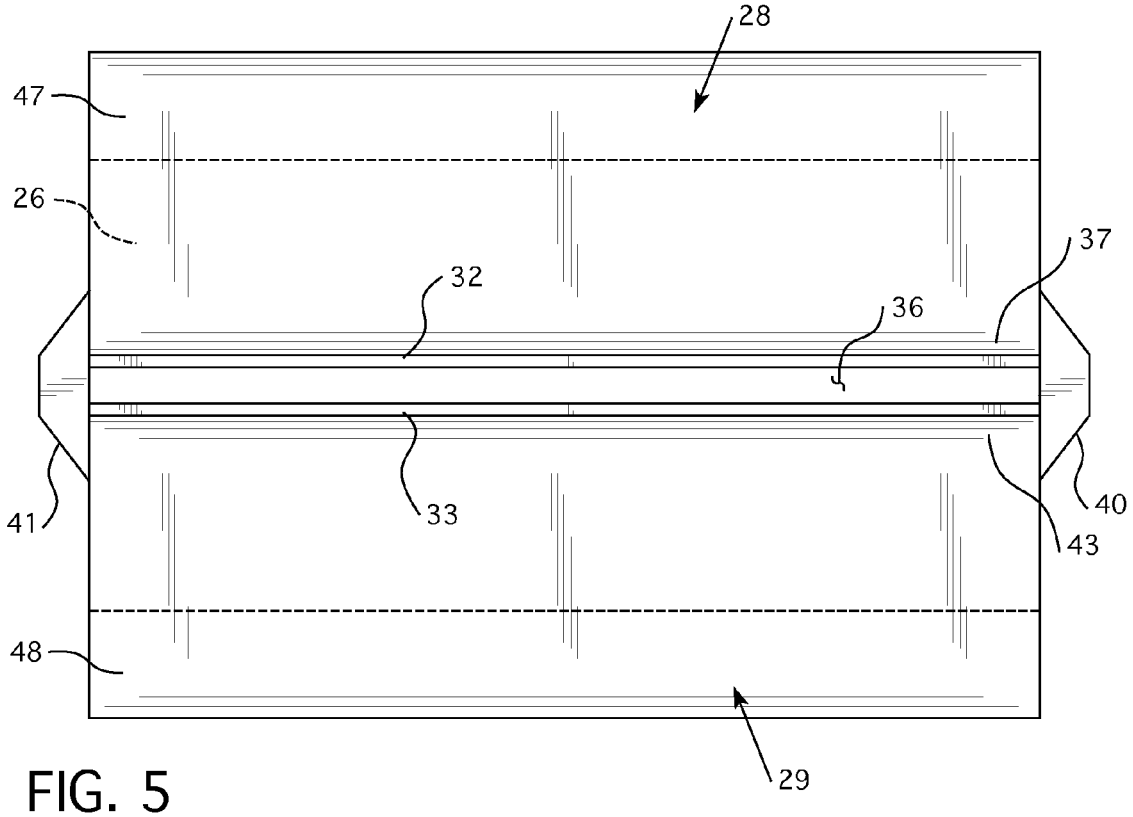
FIG. 5 is a bottom plan view of the tool of FIG. 1.
Figure 6:
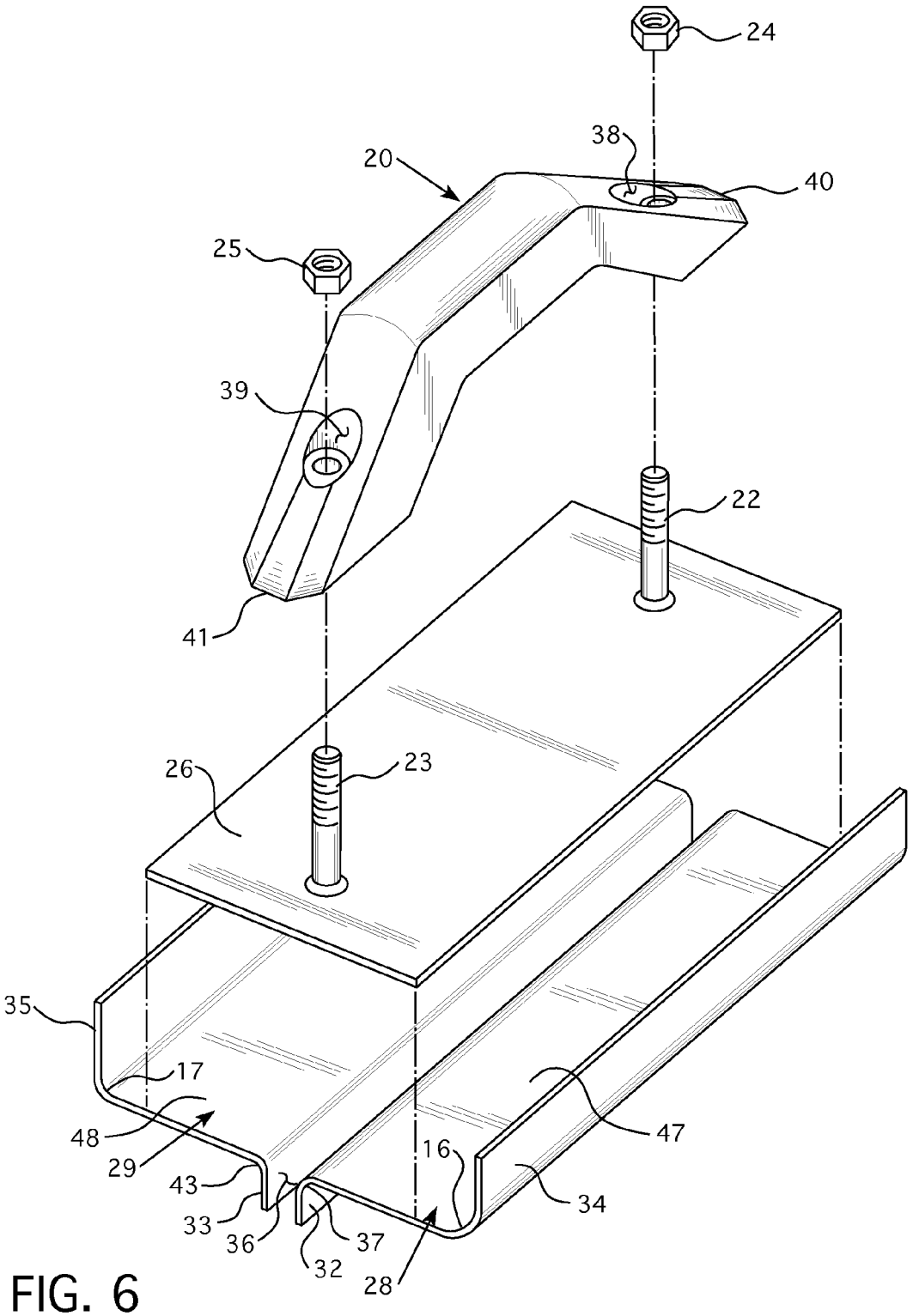
FIG. 6 shows an exploded view of the tool of FIG. 1.

Referring to FIGS. 1 through 6, there is shown the hand tool of the present invention which provides an efficient means for a straightening an expansion joint in a newly poured concrete slab. The hand tool has a handle 20 which, in the form shown, has a pair of openings 38,39 for receipt, respectively, of bolts 22,23 which pass through the openings respectively, and have their lower ends secured to plate 26 as by welds 19,21, for example. Plate 26 is, preferably, made from steel, such as a stainless steel. The upper portions of bolts 22,23 pass through the openings 38, 39, respectively, and are secured in position by nuts 24,25.

To facilitate manual engagement by the user, the handle 20 has a generally downwardly concave configuration, to provide space between the handle and plate 26 for manual engagement thereof.

The free ends of the handle 20 are tapered generally outwardly as identified by reference number 40,41. The tapered portions 40 and 41 of the handle 20 serve as a centering guide to visually assist in centering the tool over the expansion joint.

Figure 7:
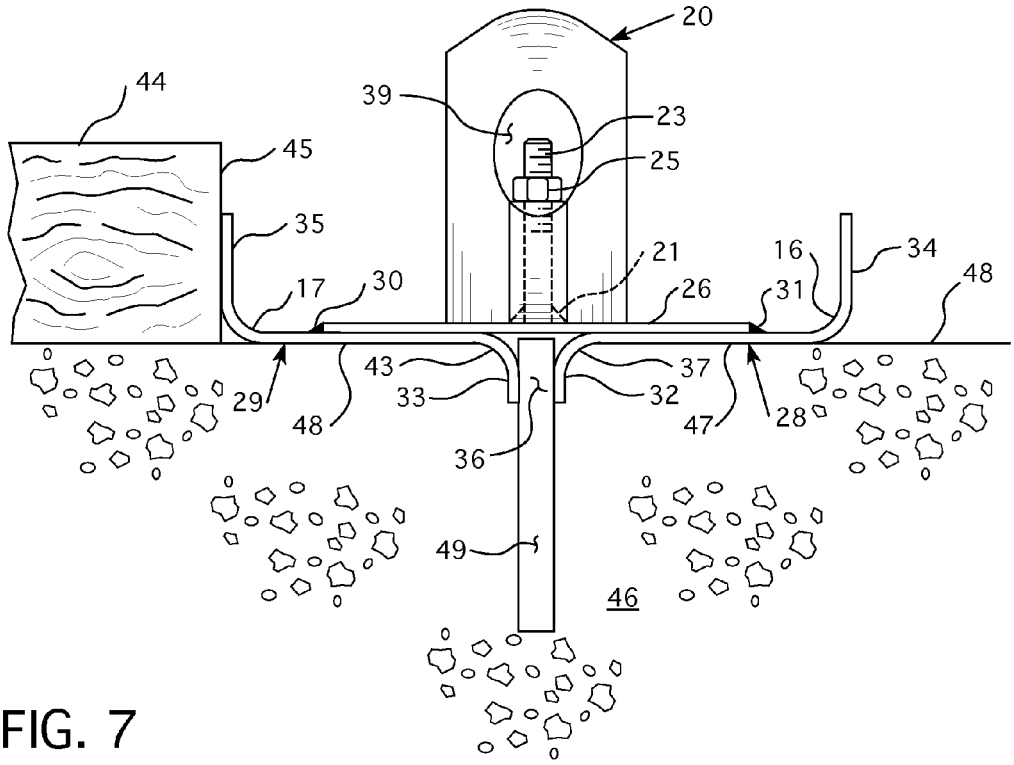
FIG. 7 shows a cross-sectional view of a concrete slab in combination with the tool of the present invention.
Figure 8:
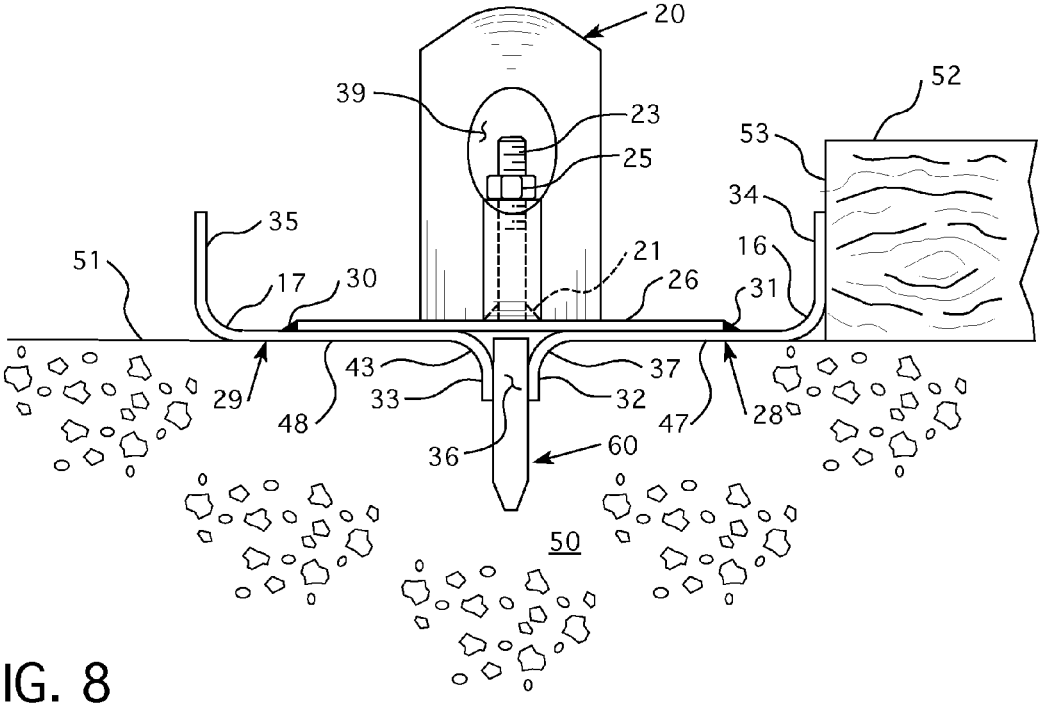
FIG. 8 shows a cross-sectional view of a concrete slab with the tool of the present invention having a control joint establishing insert in position.

With reference to FIG. 7 and 8, it will be seen that the outer surfaces of generally parallel flanges 34,35 are structured to engage straight edges positioned exteriorly thereof, such as straight edge 44 which has surface 45 in contact with the outer edge of flange 35 as shown in FIG. 7 and straight-edge 52 having outer surface 53 in contact with the outer surface of flange 34 (FIG. 8). In this manner, through the use of at least one such straight edge 44,52 which is positioned generally parallel to the expansion joint and are normally or otherwise restrained against movement. The straight edge 44,52 may be a wooden 2 by 4, for example. The hand tool may be moved in a straight line with the expansion joint received within channel 36 in a first direction to straighten the expansion joint and reciprocally moving back toward the starting point to further straighten the expansion joint. This creates an efficient means of rapidly creating the desired straight configuration for the expansion joint without having to engage in the burdensome prior art practices.

The tool has a downwardly open expansion joint guide channel 36 which receives the expansion joint 49. This channel is defined by flanges 32,33 of respectively elements 28,29 which are preferably secured to the underside of plate 26 by any suitable means such as welds 30,31, for example. At the other side of channel defining plates 28,29 are a pair of generally upwardly directed parallel flanges 34,35 which provide straight edges for guiding the hand tool. The curved transitions 37,43 disposed between the generally straight portions 47,48 of channel defining plates 28,29 and their respective flanges 32,33 serve to define the contour of the finished edge of the concrete on opposite sides of the expansion joint. These may be of any desired radius depending upon the desired finished appearance.

As shown in FIG. 7, concrete slab 46 has an upper surface 48 which is structured to support the tool of the present invention as it moves through the expansion joint 49 which is received with channel 36 between flanges 32,33 in order to straighten the joint.

As shown in FIG. 8, concrete slab 50 has upper surface 51 which supports the tool of the present invention for relative sliding movement thereof.

Figure 9:
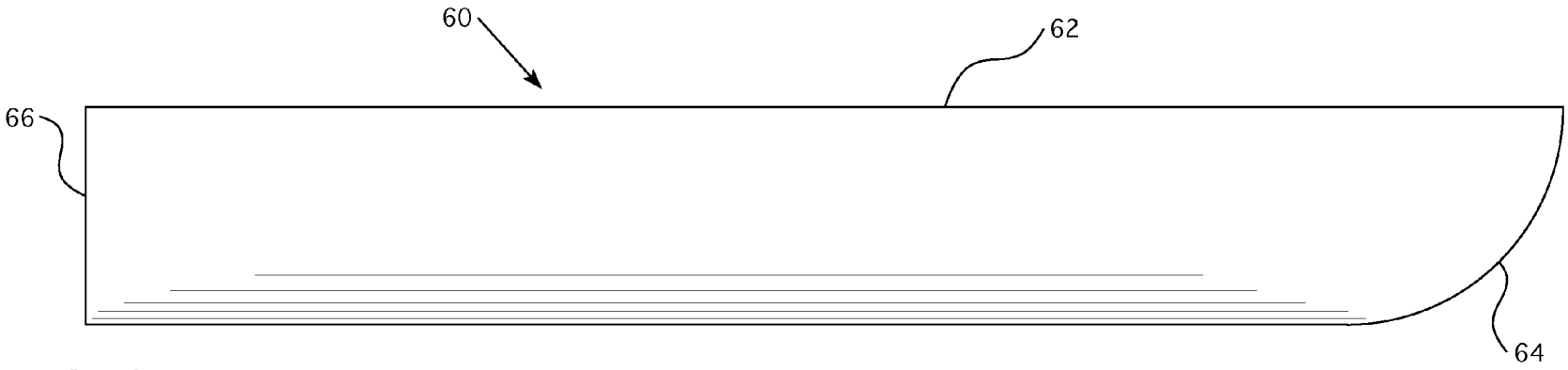
FIG. 9 is a front elevational view of a control joint tool of the present invention.
Figure 10:
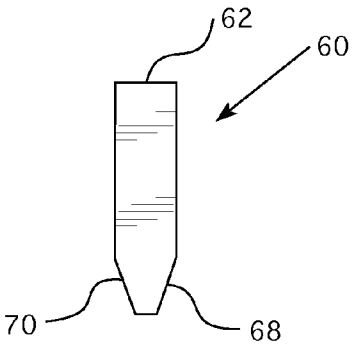
FIG. 10 is a left side elevational view of the control joint insert of the present invention.

Referring to FIGS. 8 and 9, reference will be made to an additional feature of the present invention wherein a control joint which is well known in concrete construction is established in a unique manner employing the tool of this invention. A control joint serves to resist undesired cracking of the concrete. In the present invention, as shown in FIG. 8, the tool of the present invention has a downwardly open channel 36 which is structured to receive a control joint piece 60 for positioning within concrete slab 50. Referring to FIGS. 9 and 10, certain details of the control joint piece 60 will be considered. The control joint piece 60 has a generally flat upper surface 62 and two surfaces 68,70 tapering toward the bottom. The leading edge 64 is curved so as to facilitate movement thereof through the concrete and the trailing edge is generally flat. This enables the tool to function in one mode as an expansion joint guide for straightening the expansion joint and, in another mode, where it is desired to create the control joint, the tool for creating the same by inserting the control joint piece 60 followed by moving the tool through the concrete where the control joint is desired to he established.

Whereas particular embodiments of the invention have been described herein for purposes of illustration, it will be appreciated by those skilled in the art that numerous variations of the details may be made without departing from the invention as described in the appended claims.

What is claimed is:

1. A hand tool for concrete concrete construction structured to straighten an expansion Joint in a concrete slab comprising a base having a downwardly open expansion joint receiving channel and a pair of relatively spaced generally upwardly projecting outer flanges, a handle secured to said base, said base having first and second adjacent base elements, a pair of inner generally downwardly extending flangs cooperating to define said downwardly open expansion joint receiving channel, whereby manual engagement of said handle and insertion of said expansion joint in said expansion joint receiving channel will permit tool movement to straighten said expansion joint, a base plate interposed between said first and second adjacent base elements and said handle, said first and second adjacent base elements fixedly secured to said base plate, said upwardly projecting outer flanges being oriented generally perpendicular to a plane passing through said base plate, and said generally upwardly projecting outer flanges structured to be in contact with a straight edge for guiding said tool.

2. The tool of claim 1 including said handle secured to said base plate.

3. The tool of claim 1 including said handle having an opening for receipt of the user's hand.

4. The tool of claim 1 including said expansion joint receiving channel being disposed generally in the center of said base.

5. The tool of claim 1 including said expansion joint receiving channel having a forwardly disposed end and a rearwardly disposed end, and said handle having a forwardly projecting portion extending forwardly beyond said forwardly disposed end of said expansion joint channel.

6. The tool of claim 1 including said handle being secured to said base by mechanical fasteners.

7. The tool of claim 1 including said expansion joint receiving channel being structured to receive a control joint piece for creating said control joint within a recess in a concrete slab.

8. The tool of claim 7, including said expansion joint receiving channel being structured to receive a said control joint piece which has a generally flat upper surface and a pair of generally parallel downwardly depending outer surfaces.

9. The tool of claim 1 including said generally upwardly projecting outer flanges being generally parallel to each other.

10. The tool of claim 1, including said first and second adjacent base elements having generally straight portions interposed between said respective generally upwardly projecting outer flanges and said downwardly extending flanges with curved transition portions disposed between said generally straight sections and said downwardly extending flanges having predetermined radii to establish the contour of the concrete adjacent to said expansion joint.

11. The tool of claim 10 including;

said inner generally downwardly extending flanges being oriented generally perpendicular to said straight sections with said curved transition portions interposed therebetween.

12. A method for straightening an expansion joint in a concrete slab comprising providing a hand tool which has a base having a downwardly open expansion joint receiving channel and a pair of relatively spaced generally upwardly projecting outer flanges, a handle secured to said base, positioning said tool with expansion joint extending into said expansion joint receiving channel and moving said tool in a first direction to straighten said expansion joint followed by movement of said tool in the reverse direction to effect straightening of said joint, said base having first and second adjacent base elements, a pair of inner generally downwardly extending flanges cooperating to define said downwardly open expansion joint receiving, channel, whereby manual engagement of said handle and insertion of said expansion joint in said expansion joint receiving channel will permit tool movement with respect to said channel engaging channel to straighten said expansion joint, and;

positioning a straight edge adjacent an outer surface of one of at least said pair of generally upwardly projecting outer flanges for guiding said tool, and fixedly securing said straight edge during movement of said tool to straighten said expansion joint.

13. The method of claim 12 including said first and second adjacent base elements having generally straight portions interposed between said respective generally upwardly projecting outer flanges and said downwardly extending flanges with curved transition portions disposed between said generally straight sections and said downwardly extending flanges having predetermined radii to establish the contour of the concrete adjacent to said expansion joint.

14. The tool of claim 13 including said inner generally downwardly extending flanges being oriented generally perpendicular to said straight sections with said curved transition portions interposed therebetween.

15. The method of claim 12 including employing as said straight edge an elongated element having a surface in contact with the outer surface of a said upwardly projecting outer flange during said tool movement.

16. The method of claim 12 including a base plate interposed between said first and second adjacent base elements and said handle.

17. The method of claim 13 including said handle secured to said base plate.

18. The method of claim 13 including said first and second adjacent base elements fixedly secured to said base plate.

19. The method of claim 12 including said handle having an opening for receipt of the user's hand.

20. The method of claim 12 including said expansion joint receiving channel being disposed generally centrally on said base.

21. The method of claim 13 including said outwardly generally upwardly projecting portions of said outwardly generally upwardly projecting flanges being oriented generally perpendicular to a plane passing through said base plate.

22. The method of claim 14 including said expansion joint receiving channel having a forwardly disposed end and a rearwardly disposed end, and said handle having a forwardly projecting portion extending forwardly beyond said forwardly disposed end of said expansion joint channel.

23. The method of claim 12 including said generally upwardly projecting outer flanges structured to be in contact with a said straight edge for guiding said tool.

24. The method of claim 12 including said handle being secured to said base by mechanical fasteners.

25. The method of claim 12 including said expansion joint receiving channel being structured to receive a control joint piece for creating said control joint within a recess in said concrete slab.

26. The method of claim 12 including said expansion joint receiving channel being structured to receive a said control joint piece which has a generally flat upper surface and a pair of generally parallel downwardly depending outer surfaces.

27. The method of claim 12 including said generally upwardly projecting outer flanges being genes ally parallel to each other.

* * * * *